United States Patent [19]

Foster et al.

[11] Patent Number: 5,072,094

[45] Date of Patent: Dec. 10, 1991

[54] TUBE FURNACE

[75] Inventors: Kenneth G. Foster, Livermore; Eugene J. Frohwein, San Ramon; Robert W. Taylor; David W. Bowen, both of Livermore, all of Calif.

[73] Assignee: United States Department of Energy, Washington, D.C.

[21] Appl. No.: 580,449

[22] Filed: Sep. 11, 1990

[51] Int. Cl.[5] ..... F27B 5/14; F27D 11/00

[52] U.S. Cl. ..... 219/390

[58] Field of Search ..... 219/390, 385, 204, 205; 373/152, 159, 137; 432/148; 126/99 R, 99 A

[56] References Cited

U.S. PATENT DOCUMENTS

| | | | |
|---|---|---|---|
| 3,641,249 | 2/1972 | Higgins | 219/390 |
| 3,651,240 | 3/1972 | Kirkpatrick | 219/390 |
| 3,705,253 | 12/1972 | Hicks | 219/311 |
| 3,972,682 | 8/1976 | Stephen et al. | 219/390 |
| 3,993,237 | 11/1976 | Sauder et al. | 228/140 |
| 4,348,580 | 9/1982 | Drexel | 219/390 |
| 4,367,866 | 1/1983 | Acker et al. | 266/99 |
| 4,417,346 | 11/1983 | Giler | 373/137 |
| 4,486,888 | 12/1984 | Sevink | 373/130 |
| 4,823,359 | 4/1989 | Ault et al. | 373/137 |
| 4,886,954 | 12/1989 | Yu et al. | 219/390 |
| 4,954,685 | 9/1990 | Kumagai et al. | 219/390 |

FOREIGN PATENT DOCUMENTS 1315187 12/1961 France .

*Primary Examiner*—Teresa J. Walberg
*Assistant Examiner*—Tuan Vinh To
*Attorney, Agent, or Firm*—Henry P. Sartorio; L. E. Carnahan; William R. Moser

[57] ABSTRACT

A vermiculite insulated tube furnace is heated by a helically-wound resistance wire positioned within a helical groove on the surface of a ceramic cylinder, that in turn is surroundingly disposed about a doubly slotted stainless steel cylindrical liner. For uniform heating, the pitch of the helix is of shorter length over the two end portions of the ceramic cylinder. The furnace is of large volume, provides uniform temperature, offers an extremely precise programmed heating capability, features very rapid cool-down, and has a modest electrical power requirement.

7 Claims, 3 Drawing Sheets

TUBE FURNACE

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention described herein relates generally to furnaces, and more particularly to a novel type of tube furnace, and methodology related thereto, that provides both temperature uniformity, over a long length and within a large volume, and very accurate and rapid, linear as well as non-linear, programmed heating capability.

Tube furnaces are well-known pieces of laboratory and industrial equipment. They usually comprise resistance-wound tubes of, for example, quartz or ceramic materials. Objects placed within the tube become heated when electrical current is applied to the furnace. Tube furnaces are commercially available from many manufacturing sources.

Drexel, in U.S. Pat. No. 4,348,580, issued Sept. 7, 1982, teaches a tubular furnace whose temperature controlled central region is bounded by at least one movable end wall. Isothermal conditions or temperature gradients are maintained by means of a temperature-sensing feed-back circuit. The furnace employs a central heater and two guard heaters that each are capable of independent electrical power control to provide independent resistance heating.

Yu et al., in U.S. Pat. No. 4,886,954, issued Dec. 12, 1989, discloses a hot wall furnace having a plurality of vertically adjacent electrical resistance heating elements that are wired in parallel. The plurality of resistance heating elements are disposed about the flat temperature zone of a processing chamber, for inputting different amounts of heat per unit area to adjacent segments of the zone.

Hicks, in U.S. Pat. No. 3,705,253, issued Dec. 5, 1972, discloses a furnace wall construction having a metal shell and inner fibrous insulating layer and resistance wire mounted inside the insulating layer.

Acker et al., in U.S. Pat. No. 4,367,866, issued Jan. 11, 1983, discloses a multilayer furnace construction for containment of molten metal with electrical conductors embedded in a particulate layer surrounding a removable inner vessel.

Giler, in U.S. Pat. No. 4,417,346, issued Nov. 22, 1983, and Sevink, in U.S. Pat. No. 4,486,888, issued Dec. 4, 1984, disclose other furnaces with heating coils on the inside surface.

In general, known tube furnaces are quite complex in having multi-component heating systems that are regulated by intricate and complicated control systems. Tube furnace designs offering improved simplicity, large-volume temperature uniformity, and fast and accurate programmed temperature control, would be welcomed as very beneficial in many areas of scientific and industrial research and engineering.

SUMMARY OF THE INVENTION

It is, therefore, an object of the invention to provide a tube furnace, and related methodology, that has a simple resistive heating system.

Another object of the invention is to provide a tube furnace, and related methodology, whose resistive heating system is regulated by a simple and uncomplicated control system.

A further object of the invention is to provide a tube furnace, and related methodology, having a large heating volume, of long length, whose temperature may be caused to temporarily conform to a predetermined functional program while, at the same time, also maintaining a close uniformity throughout the volume.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention is a tube furnace that maintains extremely uniform temperature over its long vertical length and within its large volume, and provides a very accurate and rapid, linear as well as non-linear, programmed heating capability. The furnace can also provide very rapid cool-down.

The furnace is operated in a vertical axial orientation because of the natural upward flow of heat. The furnace is comprised of a cylindrical stainless steel liner surrounded by a ceramic cylinder. The steel liner is provided wth a first axial slot for exapnsion and a second axial slot, positioned 180 degrees from the first slot, for thermocouple placement. The ceramic cylinder is wound with a single heating resistance wire. The ceramic cylinder is externally grooved to hold the helical turns of the resistance wire. The resistance wire turns are closely spaced at the ends of the furnace and more widely spaced at the center. Consequently, the ends of the furnace, where heat naturally escapes at a faster rate than at the center, will be provided with more heat when electrical current is passed through the single resistance wire, and thus the entire interior of the furnace will tend to have a uniform, constant temperature. For simplicity and economy in fabrication, the pitches of the end portions of the resistance wire helix are constant and equal, and the pitch of the central portion of the resistance wire helix is constant. However, in other embodiments of the invention, variable pitch winding scenarios can be utilized. Since only a single resistance wire winding, powered by a single electrical power source, is used, the control and dynamic heating of the furnace is very simple and smooth, resulting in significantly improved programmed heating performance of this furnace. The programmed temperature control of the furnace is provided by thermocouple feed-back. The single thermocouple is accommodated in the second axial slot cut into the stainless steel liner, or even in the first expansion slot in the stainless steel liner. The thermocouple may be variously positioned within and along the axis of the furnace, as convenient; however, it is generally positioned at the midpoint of the specimen to be heated. The improved sensitivity of a thermocouple positioned in this way allows unusually fine temperature control.

The furnace is insulated with vermiculite, which is located outside the ceramic cylinder and inside an outer metal can of the furnace. The furnace is essentially open-ended in use, and has insulating marinite end caps. Finally, the furnace has metal or ceramic end plates.

Apertures in the end caps and end plates are aligned with the ends of the ceramic tube.

DETAILED DESCRIPTION OF THE PREFERRED EMBODIMENTS

Figure 1:
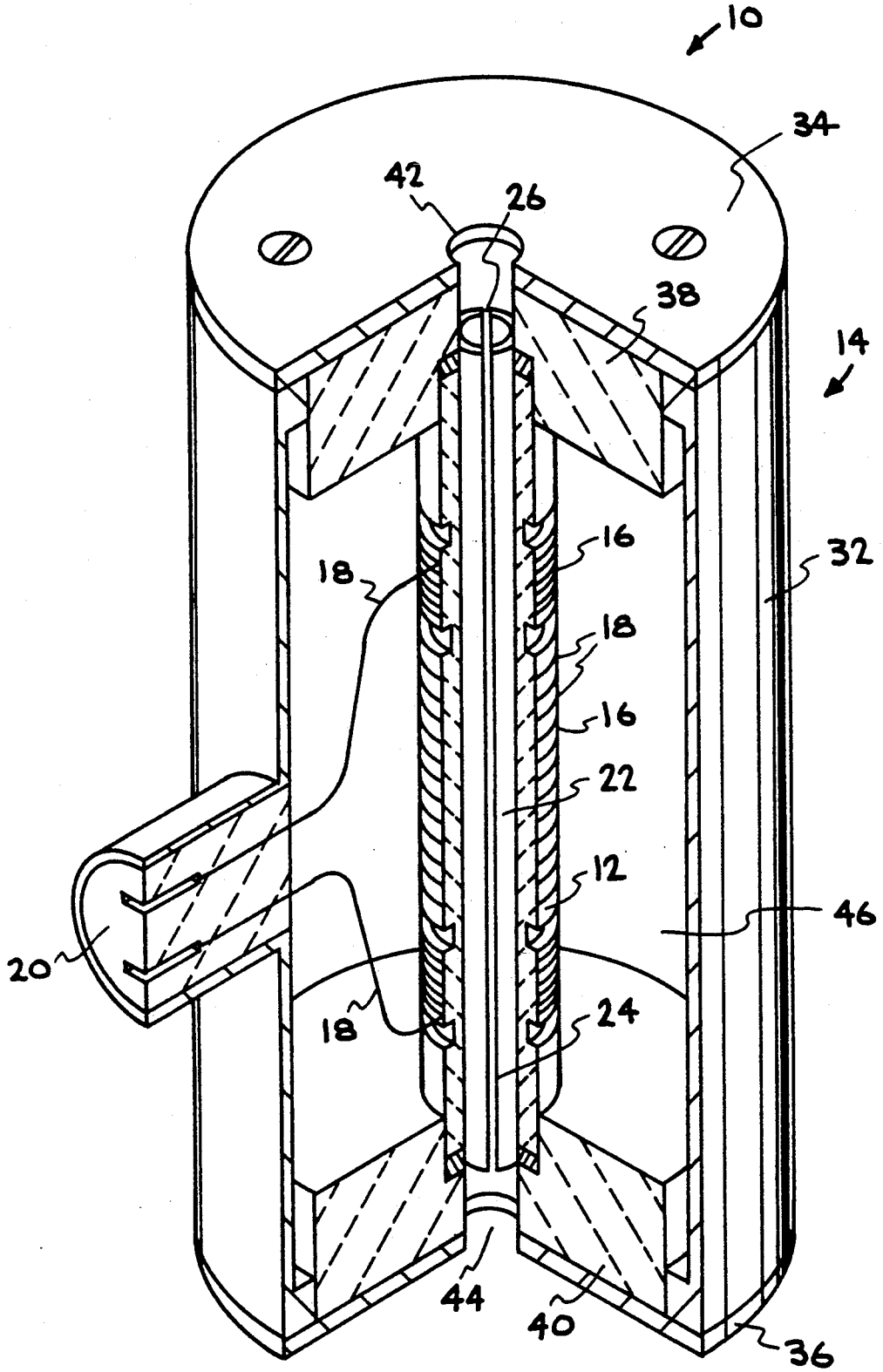
FIG. 1 is a perspective view, partly in section, of the tubular furnace according to the invention.

As shown in FIG. 1, tube furnace 10 is formed of a ceramic tube or cylinder 12 mounted in a housing 14. Ceramic tube 12 is typically positioned in a vertical axial orientation in housing 14 because of the natural upward flow of heat; however, other orientations of the ceramic tube can also be utilized. The exterior lateral surface of ceramic tube 12 has a helical groove 16 formed along its length and electrical resistance heating wire 18 is wound around ceramic cylinder 12 in the helical groove 16 for heating the ceramic tube to furnace temperature. The ends of wire 16 are attached to an electrical receptacle 20 formed in the housing 14. The grooves are formed in the ceramic by any suitable means, e.g., machining by a diamond wheel or lathe. An axially slotted liner or tube 22 made of stainless steel or other metal fits snugly within ceramic tube 12. Because of its high thermal conductivity, liner 22 provides more uniform temperature distribution within the ceramic tube 12. Liner 22 is provided with a first axial slot 24 for expansion and a second axial slot 26 positioned 180 degrees from the first slot for thermocouple placement. Axial expansion slot 24 extends the entire length of liner 22, while second slot 26 for thermocouple placement may extend only half the length or less, or even be eliminated in some designs.

Figure 2:
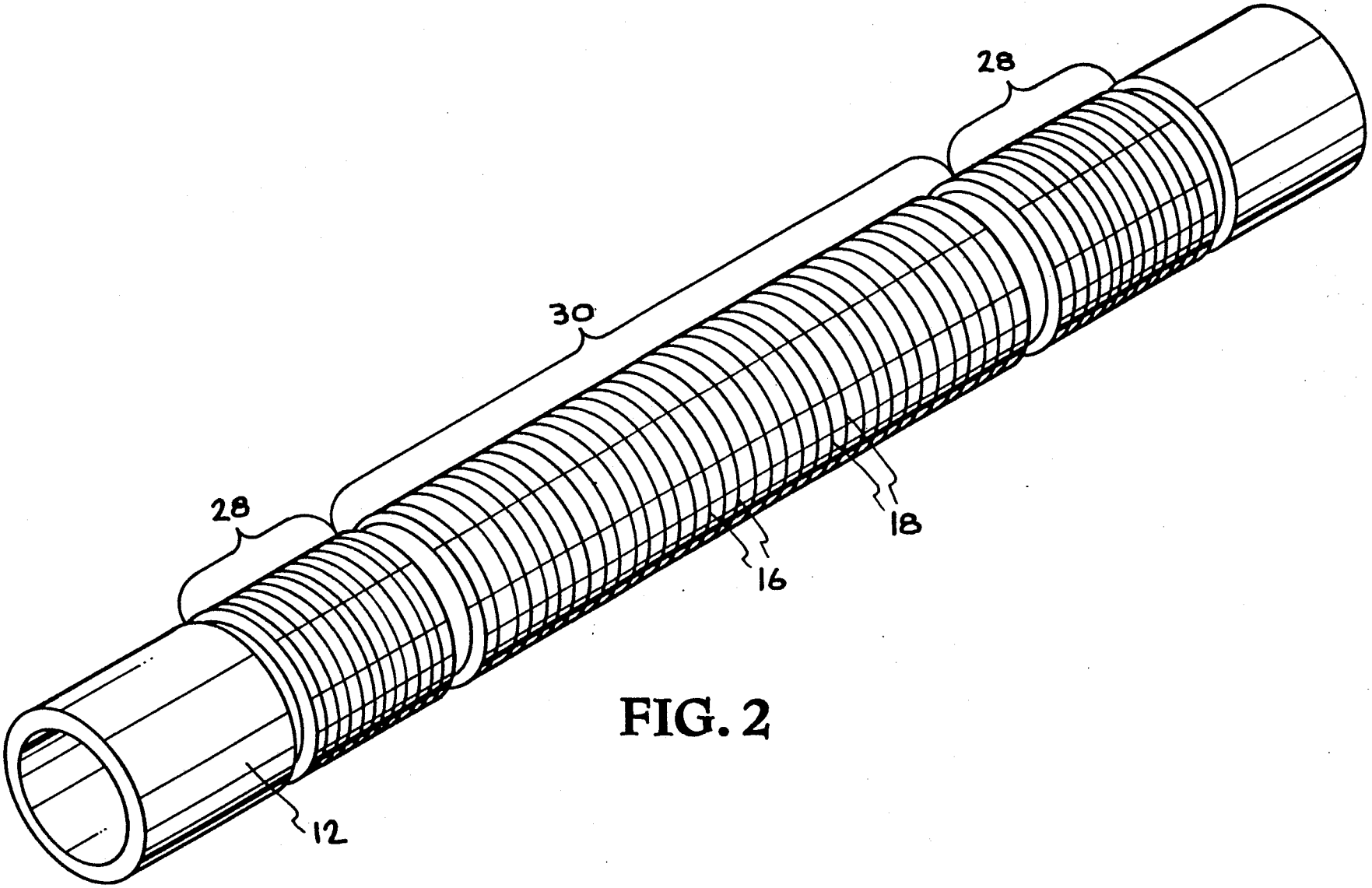
FIG. 2 is a perspective view of the resistance wire wound ceramic cylinder showing the greater helical pitch of the end portions compared to the central portion.
Figure 3:
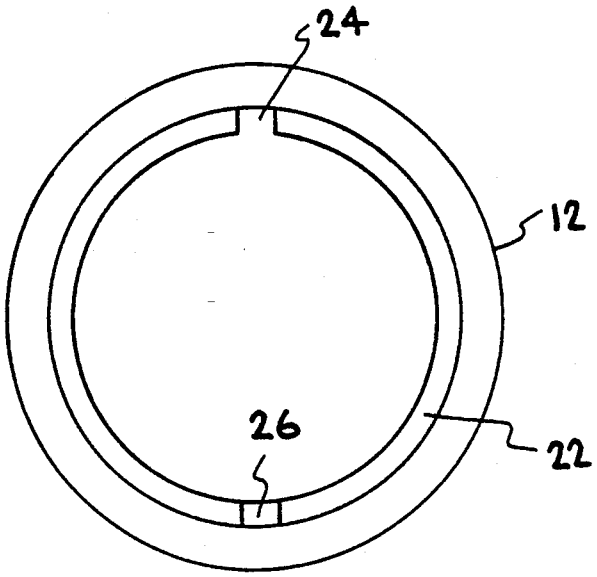
FIG. 3 is an end view of the ceramic cylinder with interior cylindrical liner showing the axial expansion slot and thermocouple slot in the liner.

Further details of the resistance wire wound ceramic tube 12 and stainless steel liner 22 are shown in FIGS. 2 and 3. A ceramic such as alumina is preferred. Although the resistance wire can be wound with a constant pitch along the entire ceramic tube, it is preferable to provide the ends of the tube with more heat since heat naturally escapes at a faster rate at the ends than at the center in order to maintain a more uniform temperature distribution throughout the entire volume of the furnace. Therefore, it is preferable to space the turns of the helical groove 16 more closely in end regions 28 of ceramic tube 12 than in the central portion 30, as shown in FIG. 2. Resistance wire 18 will then be wound more tightly (more turns per unit length) in end regions 18 than in central portion 30, providing more heat to the end regions to achieve balance with heat loss and ensure uniform constant temperature within the furnace. Although as shown in FIG. 2 the winding pitch in end regions 28 is constant and greater than the constant pitch in central region 30, in other embodiments variable winding pitches along the entire length of the ceramic tube 12 could be utilized. FIG. 3 is an end view of ceramic cylinder 12 with interior metal liner 22 showing the axial expansion slot 24 extending along the entire length of the liner and thermocouple positioning slot 26 extending partially along the length of the liner.

The insulating housing 14 which encloses the electrically heated ceramic tube 12 with metal liner 22 is formed of a metal can or other container 32 which has a top 34 and bottom 36, with insulators 38 and 40, typically made of marinite (a ceramic), disposed about the end portions of the ceramic tube 12 within the container 32 adjacent to the top 34 and bottom 36, respectively. Apertures 42 and 44 formed in the top and bottom 34 and 36 and insulators 38 and 40, provide for the interior of the ceramic cylinder 12 to communicate with and vent outside the furnace 10. The interior of furnace 10 between the ceramic tube 12 and container 32 between the two end insulators 38, 40, is also filled with an insulating material, preferably vermiculite. Vermiculite is a micaceous material which is readily and inexpensively available and can be reused in the furnace and which provides rapid cooling once the furnace is shut off.

Figure 4:
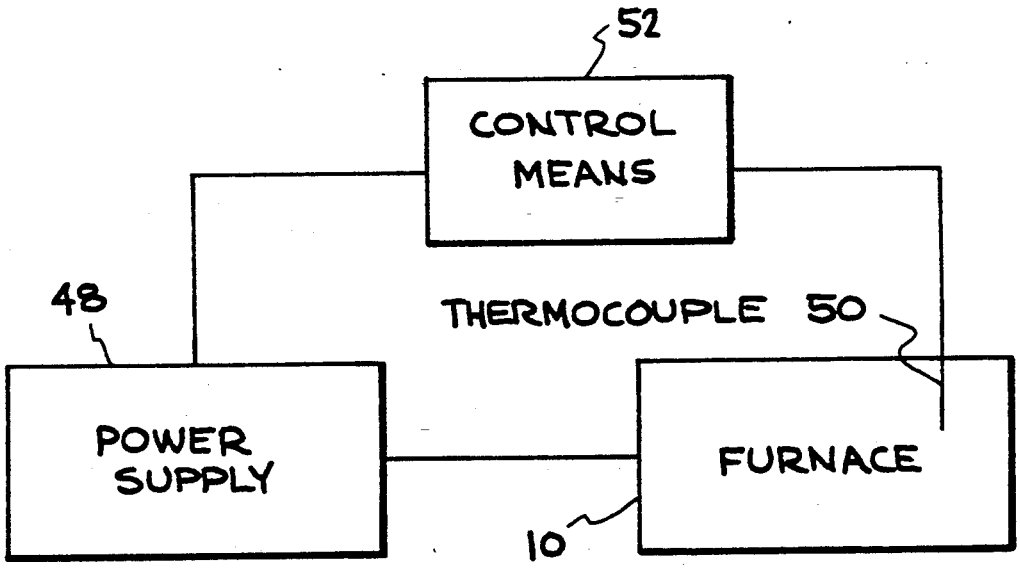
FIG. 4 is a schematic view of the temperature control system for operating the furnace.

The furnace is essentially open-ended in use, and maintains extremely uniform temperature over its long length and within its large volume. The temperature control means are illustrated schematically in FIG. 4. power supply 48 is connected to the furnace 10, e.g., by connection through receptacle 20 to resistance wire 18, as shown in FIG. 1. Thermocouple 50 is positioned in the furnace, typically in thermocouple slot 26 of metal liner 22, as shown in FIG. 1. Thermocouple 50 is connected to temperature control means 52, which is connected to and controls power supply 48. Control means 52 may be programmable so the temperature in the furnace will conform temporally to a predetermined program. The feed-back control system provides very accurate and rapid heating capability, both linear as well as non-linear. For example, a linear heating rate of 4° C. per minute can be precisely realized. Since only a single resistance wire winding powered by a single electrical power source is used, the control and dynamic heating of the furnace is very simple and smooth. Thermocouple feedback is provided by a single thermocouple positioned in the second axial slot formed in the liner; alternatively, the thermocouple could be positioned in the axial expansion slot or elsewhere within the furnace. The midpoint of the furnace is generally the preferred position.

In addition to its other advantages, the tube furnace according to the invention does not require the use of asbestos, and requires the use of relatively moderate power.

Although a tube furnace according to the invention can be built with a wide range of dimensions, an illustrative furnace is made of a high temperature alumina ceramic tube 10" long and 1.13" OD×0.85" ID. The helical groove is a continuous groove 0.03" deep×60° with a total of 60 turns wound with 0.031" dia. Kanthal resistance wire. The central 5" is wound with 30 turns @ 6 threads per inch while a pair of 1.25" end portions adjacent to the central portion are each wound with 15 turns @12 threads per inch, leaving 1.25" at each end with no wire. The stainless steel liner is 10.25" long with 0.84" OD and 0.718" ID. The diameter of the outer container is 6" with a wall thickness of 0.083" and a height of 12". The end plates are 6" in diameter and 0.125" thick. The end insulators are 5.315" in diameter and 1.5" thick. The components are attached together using conventional means.

Changes and modifications in the specifically described embodiments can be carried out without departing from the scope of the invention which is intended to be limited only by the scope of the appended claims.

We claim:

1. A furnace, comprising:

a hollow ceramic tube having an external cylindrical surface into which a single helical groove of variable pitch has been formed;

a resistance wire, having two ends, wound within the helical groove of the ceramic tube;

an electrical receptacle, attached to the two ends of the resistance wire, for receiving electrical power from an external source;

a hollow metal cylindrical liner snugly disposed within said ceramic tube, said metal liner having an axial expansion slot that extends its entire length, and an axial thermocouple slot that extends less than its entire length; and an insulating housing, for insulating the grooved external cylindrical surface of the ceramic tube, said housing adapted both to permit the electrical receptacle to extend therethrough, and to permit unimpeded ventilation through the hollow metal liner.

2. A furnace, as recited in claim 1, wherein the external cylindrical surface of the ceramic tube comprises a central portion and two end portions that are adjacent to the central portion, wherein the helical groove has a first pitch over said central portion, wherein the helical groove has a second pitch over said two adjacent end portions, and wherein the second pitch is greater than the first pitch.

3. A furnace, as recited in claim 2, wherein the ceramic tube is made of alumina and the metal liner is made of stainless steel.

4. A furnace, as recited in claim 3, wherein the insulating housing is comprised of two marinite end insulators disposed about the two immediate end portions of the external cylindrical surface of the ceramic tube, a metal can surroundingly disposed about the two marinite end insulators, said metal can adapted to permit the electrical receptacle to extend therethrough, and having two apertures to permit unimpeded ventilation through the hollow metal liner, and a quantity of vermiculite disposed within the metal can surrounding the portion of the external cylindrical surface of the ceramic tube that is not being insulated by the marinite end insulators.

5. A furnace, as recited in claim 1, further comprising:

a thermocouple positioned within the thermocouple slot of the metal liner;

a programmed thermocouple feed-back temperature control means, that senses temperatures measured by the thermocouple and therewith adjusts the amount of power from the external source received through the electrical receptacle into the resistance wire, whereby the temperature within the metal liner is caused to temporarily conform to a predetermined functional program.

6. A furnace, as recited in claim 4, further comprising:

a thermocouple positioned within the thermocouple slot of the metal liner;

a programmed thermocouple feed-back temperature control means, that senses temperatures measured by the thermocouple and therewith adjusts the amount of power from the external source received through the electrical receptacle into the resistance wire, whereby the temperature within the metal liner is caused to temporarily conform to a predetermined functional program.

7. A method for providing a volume within which the temperature, while being closely uniform throughout, is caused to temporally conform to a predetermined functional program, the method comprising the steps of:

providing a hollow ceramic tube, having an external cylindrical surface comprised of a central portion and two end portions that are adjacent to the central portion;

forming a single helical groove into the external cylindrical surface of the ceramic tube, with the helical groove having a first pitch over the central portion of the external cylindrical surface and a second pitch over the two adjacent end portions of the external cylindrical surface, and with the second pitch being greater than the first pitch;

winding a resistance wire within the helical groove of the ceramic tube;

snugly disposing a hollow metal cylindrical liner, having an axial expansion slot that extends its entire length, and having an axial thermocouple slot that extends less than its entire length, within the ceramic tube;

insulating the grooved external cylindrical surface of the ceramic cylinder;

positioning a thermocouple within the thermocouple slot of the metal liner;

supplying the resistance wire with electrical power to heat the ceramic tube;

sensing the temperature measured by the thermocouple; and adjusting the amount of power provided to the resistance wire by said supplying step, in response to said sensing step, whereby the temperature in the space within the metal liner is maintained closely uniform throughout, and is caused to temporally conform to a predetermined functional program.

* * * * *